United States Patent [19]

Bahls

[11] 4,288,884

[45] Sep. 15, 1981

[54] MOP HAVING SKIP SLIT ABSORPTIVE ELEMENT

[75] Inventor: Jerold O. Bahls, St. Paul, Minn.

[73] Assignee: Minnesota Mining and Manufacturing Company, Saint Paul, Minn.

[21] Appl. No.: 121,008

[22] Filed: Feb. 13, 1980

[51] Int. Cl.[3] ..... A47L 13/16; A47L 13/20

[52] U.S. Cl. ..... 15/244 R; 15/229 R; 428/131

[58] Field of Search ..... 15/116 A, 119 A, 209 B, 15/209 C, 224, 226, 228, 229 R, 229 A, 229 AC, 229 AP, 244 K, 244 A, 244 C; 428/131

[56] References Cited

U.S. PATENT DOCUMENTS

| | | | |
|---|---|---|---|
| 1,888,986 | 11/1932 | Hertzber | 15/229 R X |
| 1,977,948 | 10/1934 | McNamara | 15/229 |
| 2,153,023 | 4/1939 | Pattee | 15/229 |
| 2,230,101 | 1/1941 | Bakemeier | 15/229 R X |
| 2,958,885 | 11/1960 | Donney | 15/209 R X |
| 3,099,854 | 8/1963 | Goodloe | 15/209 B |
| 4,097,952 | 7/1978 | Lindstrom | 15/229 R X |
| 4,114,224 | 9/1978 | Disko | 15/229 A |

*Primary Examiner*—Chris K. Moore

*Attorney, Agent, or Firm*—Cruzan Alexander; Donald M. Sell; Richard Francis

[57] ABSTRACT

An improved mop of the type comprising a conventional handle and frame and including a novel absorptive element comprising a skip slit absorptive sheet in the shape of a lattice. The absorptive element has an unslit portion capable of being fastened by the mop frame and the drapable working portion which has been skip slit to provide a lattice structure. A web may be attached to at least one surface of the fastening portion of the absorptive material so as to extend part way over the drapable working portion to provide a scouring surface and/or to reinforce the fastening portion of the absorptive element.

8 Claims, 6 Drawing Figures

MOP HAVING SKIP SLIT ABSORPTIVE ELEMENT

BACKGROUND OF THE INVENTION

1. Field of the Invention

This invention relates to an improved mop having an absorptive element which has been skip slit.

2. Prior Art

The more well known and popular absorptive elements of mops are those formed of numerous strands of fibrous absorbent material such as cotton. Cotton or similar fibers are typically spun into long cylindrical yarns which make them quite suitable for use in mops. However, cotton and similar fibers have certain disadvantages which makes their use not entirely satisfactory. Such disadvantages include relatively high cost to produce, a tendency to leave lint or broken segments on the freshly cleaned surface, and relatively heavy weight as compared to cleaning implements formed of sponge materials such as cellulose.

Various attempts have been made to utilize felt, cellulose or other sponge or foam sheet material, and the like, which has been slit to provide a multitude of strands of this material as an absorptive element. U.S. Pat. No. 4,097,952 discloses a mop which utilizes such an absorptive element. While such a mop may avoid the problems associated with utilizing cotton or similar materials, it has its own problems due to the inherent weakness of the sponge absorbent material which causes the strands to readily break, particularly when they are wet near their capacity with water which creates a relatively high force on the upper portion of the strand as the mop is lifted through the air. Additionally, such a stranded mop element has difficulty making uniform surface contact with the floor being mopped because the stranding process produces rectangular or square cross-section strands which tend to lie in a haphazard way as the mop is applied to the floor and which tend to tangle easily. This haphazard and many times tangled arrangement inherently causes some of the strands to lie on their corners rather than on a flat side, reducing the contact area by a considerable degree.

SUMMARY OF THE PRESENT INVENTION

The present invention provides a novel mop which avoids the problems stated above. The mop of the present invention comprises a conventional handle and fastening means with a novel absorptive element which has a fastening portion and at least one drapable working portion which has been skip slit to provide a lattice formed of the absorptive material. "Skip slit" is a term commonly employed to refer to a pattern of slitting which provides equally spaced parallel rows of uniformly spaced slits of equal length with slits being off set from one another in adjacent rows. Such a slitting pattern inherently produces a lattice.

Preferably, the fastening portion of the mop absorptive element has a web attached to one surface thereof to reinforce and/or facilitate cleaning such as provided by a scouring web which provides a scouring surface. The web preferably is coextensive with the surface which with it is associated and most preferably it extends partially over the drapable working portion of the absorptive element but preferably does not cover the entire working portion. The preferred web is a low density nonwoven lofty abrasive product of the type sold under the registered trademark "Scotch-Brite" by the assignee of the present invention. A preferred absorptive element has an intermediate fastening portion with opposed drapable working portions on either side thereof.

The lattice provides connecting points between the strands which provides for reinforcement and eliminates the tendency of the strands to tangle and to fall in a haphazard way by maintaining the slit sheet in a planar deployment with respect to the surface being mopped.

BRIEF DESCRIPTION OF THE DRAWINGS

The invention may be better understood by reference to the drawing wherein like reference numerals refer to like parts and.

DETAILED DESCRIPTION OF THE PREFERRED EMBODIMENTS

Figure 1:
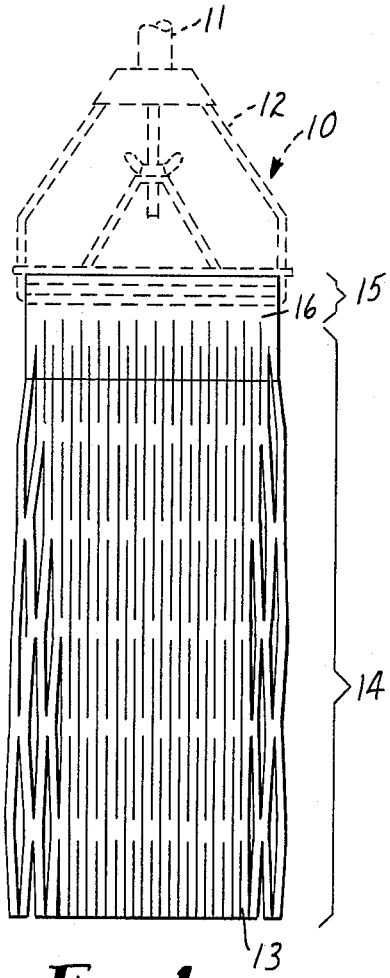
FIG. 1 is a perspective front view of a preferred mop according to the present invention.
Figure 2:
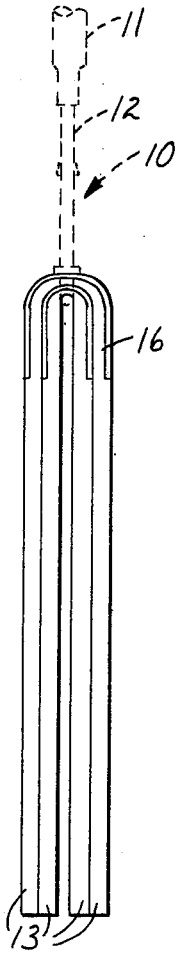
FIG. 2 is a perspective side view of the mop of FIG. 1.
Figure 3:
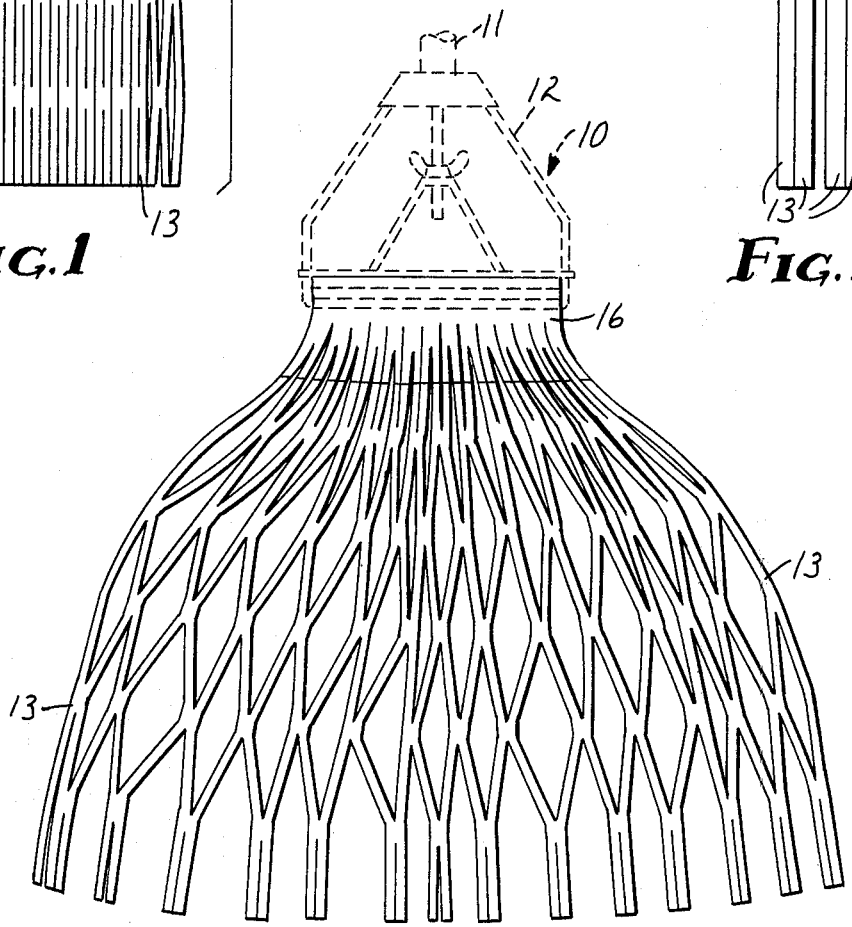
FIG. 3 is a perspective front view of the mop of FIG. 1 with the absorptive element extended sideways to show more detail of the same.

Referring particularly now to the drawing, in FIGS. 1–3, there is shown a mop 10 comprising a handle 11 (only the end segment thereof being shown), fastened to a mop frame 12 of a conventional type which fastens therein absorbent element 13. Absorbent element 13, as can be seen in FIGS. 1–5, comprises a sheet of absorbent material, e.g., felt, sponge or foam sheeting, and the like, which has been slit to provide a drapable working portion 14 in the form of a lattice and an unslit fastening portion 15 for fastening to the frame.

Web 16 may be attached to absorbent element 13 coextensive with fastening portion 15 and extending part of the way over drapable portion 14. Such attachment may be by actually embedding web 16 into absorbent element 13 if the absorbent element is a cellulose sponge, for example, or by other fastening means, e.g., adhesives or mechanical fastening means such as heat bonding, sewing, stapling and the like. The exposed surface 17 of web 16 may be in the same plane as the exposed surface 18 of absorbent element 13, or surface 17 may extend above surface 18, depending upon the fastening means selected, as will be understood. For example an embedded web may have an exposed surface in the same plane while the surface of a web which is sewn, adhesively bonded or stapled web would extend above surface 18.

The absorbent material is preferably cellulose sponge sheet material. Most preferably, this sheet material is 3 to 20 mm thick. Slitting provides a pattern of spaced parallel rows of discontinuous slits throughout the drapable portion of the absorptive element. Individual slits perferably are approximately 70 to 250 mm in length and are preferably spaced apart in the same row about 3 to 40 mm. Parallel adjacent slits are approximately 3 to 16 mm apart and are off-set from one another to provide the lattice-like structure which is characterized by having a multitude of strands which are connected in a side-by-side pattern.

Preferred mops have rectangular absorbent elements having a width on the order of 15 to 20 cm wide (most preferably 17 to 18 cm to fit existing frames) with a drapable portion on the order of 30 to 60 cm long (most preferably 40 to 50 cm).

Preferably, the absorptive element has a reinforcing web adhered, otherwise attached to or embedded into fastening portion so that this portion is strengthened to prevent failure. Most preferably, the reinforcing web also provides a scouring surface when the absorptive element is mounted within the mop frame. For this purpose, the absorptive element covered with the reinforcing web should extend from the fastening portion of the absorptive element over the drapable portion approximately 60–130 mm between the fastening portion of the absorptive element and the outer end.

At least one absorptive element is utilized in a mop. Generally, approximately two to six absorptive elements are utilized as the absorptive element in a mop. The mop may also contain two or more different types of absorptive elements.

The absorptive elements of the present invention are prepared from well known commercially available absorptive sheet materials such as cellulose sponge sheet material, hydrophillic polymeric foam materials such as that prepared from polyurethane and the like, absorbent fibrous materials such as felt, and the like. Such materials have been utilized for mop elements of different configurations and are well known items of commerce.

The sponge or foam sheet material for the absorptive element may be produced by any conventional means. The sponge or foam sheet material having an embedded or partially embedded web therein may be produced by known processes, for example, by the process disclosed in Politzer et al., U.S. Pat. No. 3,109,703.

The sheet material utilized to produce the absorptive element of the mop of the present invention may be produced by cutting a larger stock piece of such sheet material to produce a sheet of the size suitable for a particular mop frame and slitting the resultant sheet to provide the pattern of slits discussed above. Slitting and cutting may be accomplished by conventional techniques with conventional cutting equipment such as, for example, with cutting dies laid in a pattern on a cutting board.

Figure 6:
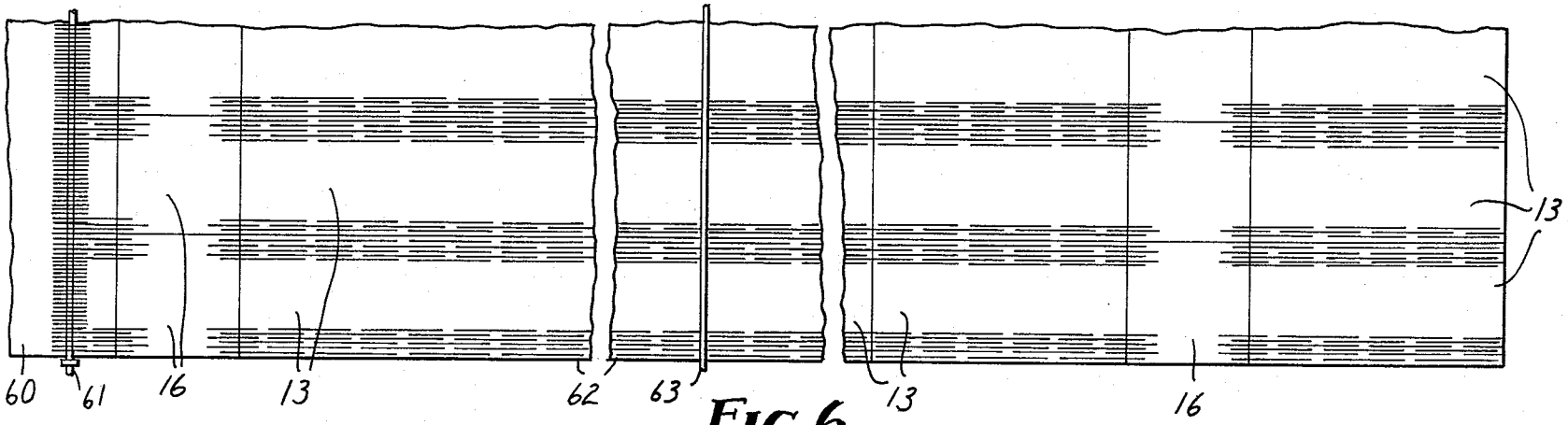
FIG. 6 is a top plan view of an apparatus employed in the continuous production of a plurality of the absorptive elements of the type depicted in FIG. 5, but showing only a part of the slits to avoid repetition of detail.
Figure 5:
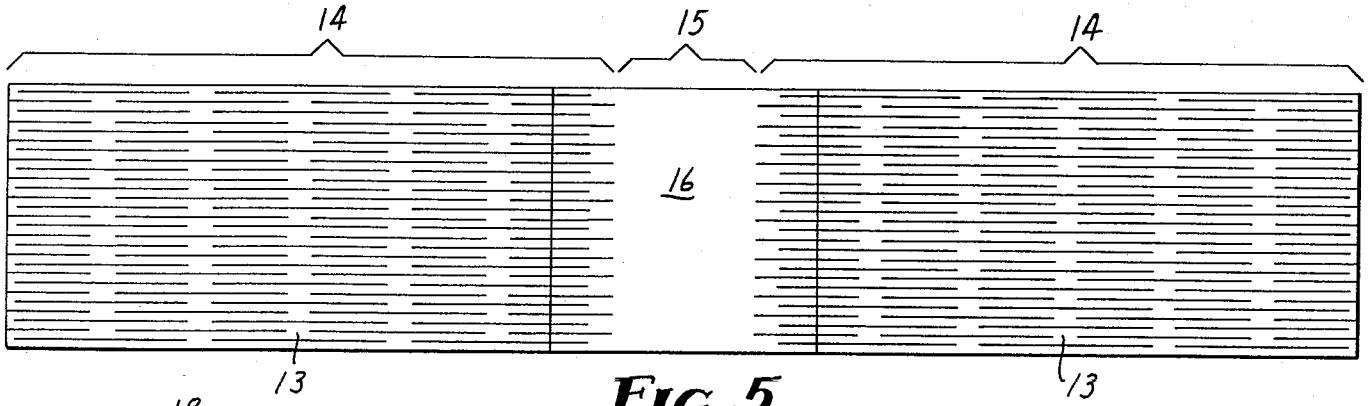
FIG. 5 is a top plan view of the absorptive element of the mop depicted in FIGS. 1–3.
Figure 4:
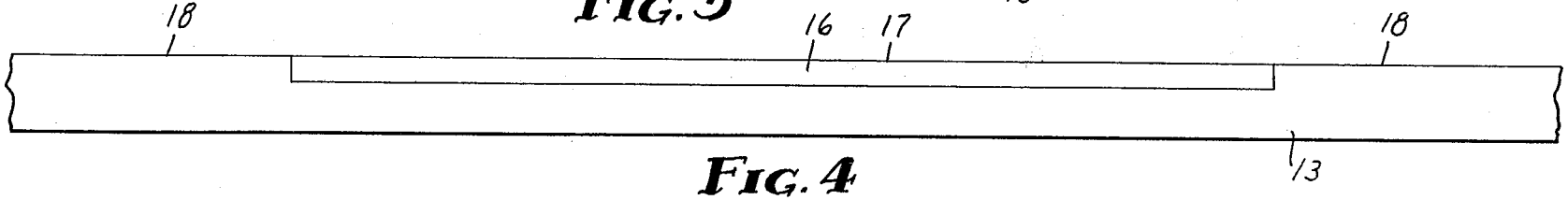
FIG. 4 is an expanded side view of the intermediate portion of the absorptive element of the mop depicted in FIGS. 1–3.

As shown in FIG. 6, the absorptive elements may be produced in a continuous process by feeding a continuous strip of sheet material through a rotating cutting die 61 having a set of cutting knives disposed about an axial shaft, resulting in slit sheet material 62 which can then be subsequently cut into individual smaller segments, e.g., by cutter bar 63, depending upon the size desired for a particular mop frame. Other cutting techniques are also possible as will be apparent to those skilled in the art.

EXAMPLES

The invention is further illustrated by reference to the following examples, wherein all parts are by weight, unless otherwise specified.

EXAMPLE 1

An absorptive element according to the invention was prepared of a slit rectangle approximately ½ inch (1 cm) thick cellulose sponge sheet approximately 36 inch (91 cm) long and 6 inches (15 cm) wide having embedded in one side thereof, midway between the narrow ends, a 6 by 6 inch (15 by 15 cm) strip of lofty nonwoven abrasive material. The nonwoven abrasive material, available under the trade designation "Scotch-Brite" abrasive material from the 3M Company and prepared according to the disclosure of Hoover et al. (U.S. Pat. No. 2,958,593), was approximately ¼ inch (6.3 mm) thick and was comprised of 15 denier nylon crimped staple fibers which were coated with a polyurethane resinous binder containing pumice abrasive particles.

The cellulose sponge material was prepared utilizing the process described in U.S. Pat. No. 3,109,703 to produce a viscous foamed mass into which the nonwoven abrasive web was embedded. The apparatus utilized to make the sponge sheet-nonwoven laminate and regenerate the cellulose sponge is described in U.S. Pat. No. 3,276,072.

The viscous employed to produce the cellulose sponge contained approximately 8% by weight cellulose, 4.2% by weight total sulfur and had approximately 7.2% alkalinity. A mass mix precursor composition of the cellulose sponge was made by combining 270 parts of viscose, 12 parts of long fiber shredded cellulose pulp, 1050 parts Glauber's salts, yellow dye for coloring and minor amounts of water as required. The cellulose sponge was cast to yield a sponge approximately ½ inch (1 cm) thick.

The sponge abrasive sheet laminate was prepared as a continuous strip, as shown in FIG. 6, with a 6 inch (30 cm) wide nonwoven abrasive embedded midway between 30 inch (76 cm) sponge segments. The absorbent element was then slit to provide parallel slits ¼ inch (6.3 mm) apart and 5 inches (13 cm) long, with adjacent slits being off-set from one another and with ¾ inch (19 mm) gaps between the slits in the same row.

The resultant absorptive element was fastened into a mop frame of the type shown in FIGS. 1–3 and utilized for wet mopping a floor. When compared to a 24 oz. (6.8 kg) cotton mop, the mop of the invention revealed the following:

TABLE I

| Property | Cotton Mop | Ex. 1 Mop |
|---|---|---|
| dry weight | 681 grams | 210 grams |
| wet weight (total) after immersion | 4,595 grams | 4,268 grams |
| water weight delivered | 1,629 grams | 1,599 grams |
| mop weight wringer dry | 1,975 grams | 1,072 grams |
| water weight picked up from floor | 1,276 grams | 1,580 grams |
| floor drying time (with a dry mop) | 5.2 min. | 5.6 min. |
| relative area covered by mop | 1.3 | 1.0 |

As can be noted in Table I, the mop of the invention was initially lighter, held about the same weight of water as the heavier cotton mop, delivered about the same amount of water, wrung drier, and picked up somewhat more water from the floor than the cotton mop.

EXAMPLE 2

An absorptive element was prepared by heat-binding together 5 layers of slit hydrophillic needled nonwoven fabric. The nonwoven fabric was composed of 35% by weight 3.3 denier rayon fibers and 65% six denier polyester fibers. The fabric weighed approximately 0.034 grams per square cm and was approximately 990 mm long, 150 mm wide and 3 mm thick. The layers of fabric were bonded across the width of the mop at two places 50 mm on either side of the center of and parallel to the narrow ends of the absorptive element to provide 2 parallel 5 mm wide heat seals. The layers of absorptive element of the mop were slit from opposed narrow ends to provide a pattern of parallel slits 450 mm into the mop toward the center, with slits being 10 mm apart and approximately 150 mm long and being off-set from one another in adjacent rows, with approximately 75 mm between slits in the same row.

This mop performed in a superior manner when compared to the mop of the same material but with complete slitting instead of being skip slit to provide a stranded mop. The skip slit mop of the invention tangled far less than the stranded mop.

What is claimed is:

1. In a mop comprising at least one absorptive element, a handle and a frame adapted to fasten said absorptive element to one end of the handle, the improvement characterized by said absorptive element comprising a substantially flat strip of absorbent material approximately 3 to 20 mm thick and having a first portion capable of being fastened by said mop frame and at least one drapable portion having an outer end opposite said first portion and being slit from said outer end toward but not into said first portion to provide a pattern of spaced parallel rows of disconnected slits throughout the drapable portion with individual slits being approximately 70 to 250 mm in length and being spaced apart in the same row about 3 to 40 mm and parallel adjacent slits being approximately 3 to 16 mm apart and off-set from one another to provide a lattice formed of side-by-side connected strips of said absorbent material.

2. The mop of claim 1 wherein said absorptive element also includes a reinforcing web attached to one side of said first portion and being coextensive with the surface area of said first portion and extending over said drapable portion about 130 mm of the distance from said first portion to said outer end.

3. The mop of claim 2 including two to six of said absorptive elements.

4. The mop of claim 1 wherein said absorptive element comprises two drapable elements, one on either side of said first portion and integral with said first portion.

5. The mop of claim 1 wherein said web comprises a three-dimensional, open, lofty filament web formed of undulated filaments with filaments herein being bonded together at points of mutual contact.

6. The mop of claim 1 wherein said web comprises a three-dimensional open, lofty abrasive product comprised of a web of crimped staple fibers wherein fibers are bonded together at points of mutual contact with an adhesive which contains abrasive material and wherein said web is exposed on an outer surface of said absorptive element when said absorptive element is fastened in said frame whereby to provide a scouring surface.

7. The mop of claim 1 wherein said absorbent material comprises cellulose foam.

8. In a mop comprising an absorptive element, a handle and a frame adapted to fasten said absorptive element to one end of said handle, the improvement characterized by said absorptive element comprising rectangular substantially flat strips of cellulose sponge material approximately 3 to 20 mm thick, each of said strips having a first portion capable of being fastened by said mop frame and opposed substantially equal drapable portions on either side of said first portion, wherein each of said drapable portions have an outer end opposite said first portion and are slit from said outer end toward but not into said first portion to provide a pattern of spaced parallel disconnected slits throughout the drapable portion, with individual slits approximately 70 to 250 mm long and being spaced apart in the same row about 3 to 40 mm, and with adjacent parallel slits being approximately 3 to 16 mm apart and being off-set from one another to provide a lattice formed by side-by-side connected strips of said cellulose foam material, and a reinforcing web formed of a three-dimensional nonwoven lofty abrasive material partially embedded in one side of said first portion and being coextensive with said one side of said first portion and extending from drapable portion up to 130 mm of the distance from said first portion to said outer end.

* * * * *